US007348296B2

(12) United States Patent
Uyttendaele et al.

(10) Patent No.: US 7,348,296 B2
(45) Date of Patent: Mar. 25, 2008

(54) BINDERS FOR USE IN THE THERMOSENSITIVE ELEMENTS OF SUBSTANTIALLY LIGHT-INSENSITIVE THERMOGRAPHIC RECORDING MATERIALS

(75) Inventors: Carlo Uyttendaele, Mortsel (BE); Ivan Hoogmartens, The Hague (NL); Huub Van Aert, Pulderbos (BE)

(73) Assignee: Agfa HealthCare, Mortsel (BE)

( * ) Notice: Subject to any disclaimer, the term of this patent is extended or adjusted under 35 U.S.C. 154(b) by 534 days.

(21) Appl. No.: 10/859,288

(22) Filed: Jun. 2, 2004

(65) Prior Publication Data

US 2005/0003298 A1 Jan. 6, 2005

Related U.S. Application Data

(60) Provisional application No. 60/483,882, filed on Jun. 30, 2003.

(30) Foreign Application Priority Data

Jun. 6, 2003 (EP) ..... 03101660

(51) Int. Cl.
*B41M 5/30* (2006.01)

(52) U.S. Cl. ..... 503/212; 503/214

(58) Field of Classification Search ..... None
See application file for complete search history.

(56) References Cited

U.S. PATENT DOCUMENTS

| | | | | |
|---|---|---|---|---|
| 7,033,743 | B2 * | 4/2006 | Geuens et al. | 430/536 |
| 7,040,929 | B2 * | 5/2006 | Defieuw et al. | 439/631 |
| 2002/0119406 | A1 | 8/2002 | Morita | |

FOREIGN PATENT DOCUMENTS

| | | | |
|---|---|---|---|
| EP | 0 752 616 | A1 | 1/1997 |
| EP | 0 809 144 | A1 | 11/1997 |
| EP | 1 136 877 | A2 | 9/2001 |
| EP | 1 143 292 | A2 | 10/2001 |
| EP | 1 241 520 | A2 | 9/2002 |
| EP | 1 270 608 | A1 | 1/2003 |
| EP | 1 278 101 | A2 | 1/2003 |
| JP | 2001-013618 | | 1/2001 |
| JP | 2002-293825 | | 10/2002 |

OTHER PUBLICATIONS

EP Search Report 03 10 1660 (Nov. 5, 2003).

* cited by examiner

*Primary Examiner*—Bruce H. Hess
(74) *Attorney, Agent, or Firm*—Leydig, Voit & Mayer, Ltd.

(57) ABSTRACT

A substantially light-insensitive monosheet thermographic recording material comprising a support and on one side of the support a thermosensitive element, the thermosensitive element comprising at least one substantially light-insensitive silver salt of a carboxylic acid, at least one reducing agent therefor in thermal working relationship therewith and at least one binder, the at least one binder comprising at least one first polymer consisting of vinyl aceto-acetal monomer units and optionally monomer units selected from the group consisting of vinyl alcohol, vinyl acetate and itaconic acid monomer units, wherein the weight ratio of the at least one binder to the light-insensitive silver salt(s) of a carboxylic acid in the thermosensitive element is greater than 1.6; and the at least one binder optionally contains less than 40% by weight of a second polymer consisting of vinyl butyral monomer units and optionally vinyl alcohol and/or vinyl acetate monomer units.

25 Claims, No Drawings

BINDERS FOR USE IN THE THERMOSENSITIVE ELEMENTS OF SUBSTANTIALLY LIGHT-INSENSITIVE THERMOGRAPHIC RECORDING MATERIALS

CROSS-REFERENCE TO RELATED PATENT APPLICATIONS

This application claims the benefit of U.S. Provisional Application No. 60/483,882 filed Jun. 30, 2003, which is incorporated by reference. In addition, this application claims the benefit of European Application No. 03101660.3 filed Jun. 6, 2003.

FIELD OF THE INVENTION

The present invention concerns binders for use in the thermosensitive elements of substantially light-insensitive thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

EP-A 0 752 616 discloses a thermographic material comprising at least one element and wherein said element(s) contain(s) therein a substantially light-insensitive organic heavy metal salt and an organic reductor therefor, the said material being capable of thermally producing an image from said organic heavy metal salt and reductor, wherein said material contains a 1,3-benzoxazine-2,4-dione toning agent having general formula (I):

(I)

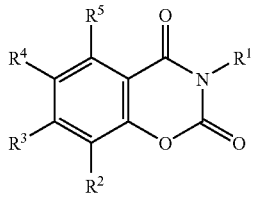

wherein $R^1$ represents hydrogen, —$CH_2OH$, —(C═O)—R, —CONHR, or M; $R^2$, $R^3$, $R^4$ and $R^5$ each independently represents hydrogen, —O—(C═O)—OR or —NH—(C═O)—OR and at least one of which is not hydrogen if $R^1$ is also hydrogen; R represents an alkyl or aryl group either of which may be substituted; and M represents a monovalent heavy metal ion. EP-A 0 752 616 further discloses that the film-forming binder of the recording layer containing the substantially light-insensitive organic heavy metal salt may be all kinds of natural, modified natural or synthetic resins or mixtures of such resins, wherein the organic heavy metal salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. EP-A 0 752 616 also alludes to binders suitable for use in the non-organic silver salt containing donor layers used in reductor transfer printing which include: cellulose derivatives, such as ethyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derivated from acrylates and acrylate derivatives, such as polymethyl methacrylate and styrene-acrylate copolymers; polyester resins; polycarbonates; copoly(styrene-co-acrylonitrile); polysulfones; polyphenylene oxide; organosilicones, such as polysiloxanes; epoxy resins and natural resins, such as gum arabic. Preferably, the binder for the donor layer of the present invention comprises poly (styrene-co-acrylonitrile) or a mixture of poly(styrene-co-acrylonitrile) and a toluenesulphonamide condensation product.

EP-A 0 809 144 discloses a substantially non-photosensitive recording material comprising a thermosensitive element comprising a substantially light-insensitive organic silver salt, an organic reducing agent therefor in thermal working relationship therewith and a binder, on a support, characterized in that said thermosensitive element further comprises in reactive association with said substantially light-insensitive organic silver salt and said organic reducing agent a substituted or unsubstituted 1,2,4-triazole compound with at least one of the nitrogen atoms having a hydrogen atom and none of the carbon atoms being part of a thione-group, said compound not being annulated with an aromatic ring system. EP-A 0 809 144 further discloses that suitable binders for the thermosensitive element may be all kinds of natural, modified natural or synthetic resins or mixtures of such resins, wherein the organic heavy metal salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

JP 2001-13618A discloses a heat developing sensitive material containing organic silver, a photosensitive silver halide, a developer, and a binder resin at least on a base material, said binder resin containing a polyvinyl aceto acetal resin in 70% by weight or more among [all] the binder resin, said polyvinyl aceto acetal resin being characterized by the degree of acetalization of more than 50 mol %. Furthermore, JP 2001-13618A discloses the following resins: polyvinyl aceto acetals from Sekisui Chemical types KS-10, KS-1 and KS-5Z; an aceto acetal/hydroxyl-group/acetyl group=88.3 mol/10.2 mol/1.5 mol resin; an aceto acetal/butyral/hydroxyl-group/acetyl group=68.5 mol/22.8 mol/8.3 mol/0.4 mol resin; a polyvinyl alcohol acetalized by acetaldehyde and butyraldehyde from DENKI KAGAKU KOGYO K.K. type DENKA butyral #3000K; and Butvar B-79 from SOLUTIA; and that the polyvinyl aceto acetal resin can also be used for an under-coating layer or a back-coat layer.

EP-A 1 241 520 discloses a silver salt photothermographic dry imaging material comprising a support having thereon a photosensitive layer comprising silver aliphatic carboxylate grains and photosensitive silver halide grains, a reducing agent for silver ions, a binder and a cross-linking agent, wherein the photothermographic material has a silver coverage of 1.0 to 1.7 g/m$^2$; the photosensitive silver halide grains have a mean grain size of 0.03 to 0.05 μm and a degree of grain size dispersity of not more than 30%; after the dry imaging material has been subjected to photothermographic processing at a temperature of 100 to 200° C. for 5 to 50 seconds, the photosensitive layer exhibits a thermal transition temperature of 46 to 200° C. In the silver salt photothermographic dry imaging material of the invention, as binder incorporated in the photosensitive layer, which includes such as silver aliphatic carboxylates, photosensitive silver halide grains and reducing agent on a support, can be employed high polymers well known in the art. The high polymers have a Tg of 70 to 105° C. The examples include: compounds comprised of polymers or copolymers containing ethylenically unsaturated monomers as constitutive units such as vinyl chloride, vinyl acetate, vinyl alcohol, maleic acid, acrylic acid, acrylate ester, vinylidene chloride, acrylonitrile, methacrylic acid, methacrylate ester, styrene, butadiene, ethylene, vinyl butyral, vinyl aceto-acetal and vinyl ether; polyurethane resins and various kinds of rubber resin. Constitutions of high polymers according to the invention of EP-A 1 241 520 are given in Table 1 and include the following polymers with butyral and aceto-acetal groups:

TABLE 1

| Polymer name | Aceto-acetal [mol %] | Butyral [mol %] | acetal [mol %] | acetyl [mol %] | hydroxyl group [mol %] | Tg value [° C.] |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-5 | 7 | 3 | 71.1 | 1.6 | 27.3 | 88 |
| P-8 | 3 | 7 | 74.4 | 0.6 | 24.0 | 75 |
| P-9 | 3 | 7 | 75.4 | 1.6 | 24.0 | 74 |

The use of Polymers P-2 and P-5 in the photosensitive layer of the silver salt photothermographic dry imaging material is exemplified.

EP-A 1 270 608, which corresponds to WO 01/053357A1 and JP 2002-201215, discloses a polyvinyl acetal resin for heat-developable photosensitive materials which is a polyvinyl acetal resin synthesized by the acetalization reaction between a polyvinyl alcohol and an aldehyde and which comprises having a degree of polymerization of 200 to 3,000, a residual acetyl group content of 0 to 25 mole percent and a residual hydroxyl content of 17 to 35 mole percent, as calculated while regarding one acetal group as two acetalized hydroxyl groups, a water content of not more than 2.5% by weight and a residual aldehyde content of not more than 10 ppm and is free of any antioxidant, perferably having a glass transition temperature of 55 to 110° C. Resins containing vinyl alcohol, vinyl acetal and vinyl butyral monomer units are disclosed in Examples 4, 5, 6 and 8 with glass transition temperatures of 80, 70, 76, 103 and 93° C. respectively of EP-1 270 608 and had the compositions given in Table 2:

TABLE 2

| | vinyl acetal {mol %/wt %] | vinyl butyral [mol %/wt %] | vinyl alcohol [mol %/wt %] | vinyl acetate [mol %/wt %] |
|---|---|---|---|---|
| Example No. | | | | |
| 4 | 38/42.6 | 31/43.3 | 29.5/12.8 | 1.5/1.3 |
| 5 | 35/37.8 | 33/44.4 | 21/8.8 | 11/9.0 |
| 6 | 35/39.8 | 32/45.3 | 32/14.0 | 1/0.9 |
| 7 | 73/86.2 | 1/1.5 | 25/11.4 | 1/0.9 |
| 8 | 63/77.0 | 1/1.5 | 22/10.4 | 12/11.1 |
| Comparative Example No. | | | | |
| 6 | 31/37.2 | 29.5/44.1 | 38/17.6 | 1.0/1.1 |

EP-1 278 101 discloses a photothermographic imaging material comprising a support having thereon a photosensitive layer comprising a photosensitive silver halide, a light-insensitive organic silver salt, a binder, and a reducing agent for silver ions, wherein the reducing agent is represented by the following Formula (S):

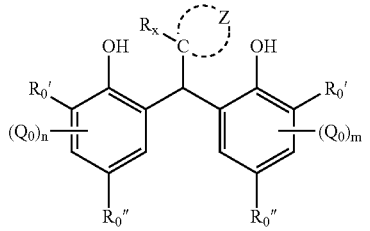

wherein Z is a group of atoms necessary to form a non aromatic ring of 3 to 10 members; Rx is a hydrogen or an alkyl group; each Ro' and Ro" is independently a hydrogen, an alkyl group, or a heterocyclic group; Qo is a substituent; and each n and m is independently an integer of 0 to 2; and plural Qo's may be the same or different. EP-A 1 278 101 further discloses the following polymers preferably employed in the invention:

TABLE 3

| Polymer name | Aceto-acetal [mol %] | Butyral [mol %] | acetal [mol %] | acetyl [mol %] | hydroxyl group [mol %] | Tg value [° C.] |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-4 | 7 | 3 | 71.1 | 1.6 | 27.3 | 88 |
| P-7 | 3 | 7 | 74.4 | 1.6 | 24.0 | 75 |
| P-8 | 3 | 7 | 75.4 | 1.6 | 23.0 | 74 |

EP-A 1 143 292 discloses a photothermographic material comprising a support having on one side of the support at least an image forming layer containing organic silver salt grains, light sensitive silver halide grains and a reducing agent and a surface protective layer, wherein the element composition on the surface of the image forming layer exhibits a ratio of the number of carbon elements to the number of oxygen elements of not more than 9, and wherein the element composition is obtained by X-ray photoelectron spectroscopy. Exemplary examples of binders disclosed for use in the image forming layer include polyvinyl acetals (e.g. polyvinyl formal, polyvinyl butyral). Of these binders vinyl acetals such as polyvinyl butyral and polyvinyl acetal, and cellulose esters such as cellulose acetate and cellulose acetate-butyrate are preferred, which may be used alone or in combination. Further, mixed acetals obtained from two aldehydes, such as polyvinyl acetobutyral are also preferred according to EP-A 1 143 292. However, such mixed acetals are not exemplified therein.

EP-A 1 136 877 discloses a photothermographic material comprising on a support light sensitive silver halide grains, an organic silver salt, a reducing agent and a binder, wherein the photothermographic material comprises a silane compound represented by formula (1) or (2):

$$(R^1O)_m\text{—Si-}[(L_1)_xR^2]_n \qquad \text{formula (1)}$$

formula (2)

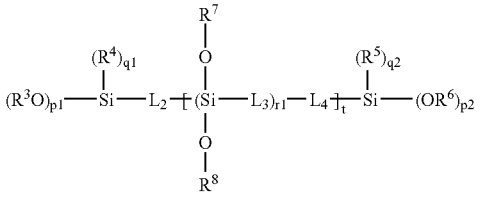

wherein $R^1$, $R^2$, $R^3$, $R^4$, $R^5$, $R^6$, $R^7$ and $R^8$ represent each an alkyl group, an alkenyl group, an alkynyl group, an aryl group or a heterocyclic group; $L_1$, $L_2$, $L_3$ and $L_4$ represent each a bivalent linkage group; m and n are each an integer of t to 3, provided that m+n is 4; p1 and p2 are each an integer of 1 to 3 and q1 and q2 are each 0, 1 or 2, provided that p1+q1 and p2+q2 are each 3; r1 and t are each 0 or an integer of 1 to 1000; and x is 0 or 1. Binders usable on the organic solvent-based coating include cellulose derivatives, polyvinyl alcohol derivatives, acrylate polymer derivatives, polyimide derivatives, polyamide derivatives, phenol resin derivatives, urethane resin derivatives and polyester derivatives. Of these, polyvinyl alcohol derivatives and vinyl acetate derivatives are preferred, particularly with vinyl acetal monomer units.

JP 2002-293825, which corresponds to WO 02/059167, discloses a polyvinyl acetal characterized by containing one or more functional groups in one molecule e.g. a carboxyl group, a silyl moiety, a is halogen moiety, an amino group, a sulfhydryl group, a sulfonyl group, a thionyl group, an epoxy group, an oxazoline moiety, a maleimide moiety, a hydroxyl group etc. An ionic group such as an acidic group (e.g. a carboxyl group or a sulfonic group) or a basic group (e.g. containing a nitrogen atom) are preferred.

US 2002/0119406 discloses a photothermographic material comprising on a support a light-sensitive layer comprising an organic silver salt, light-sensitive silver halide grains, a reducing agent and a binder, wherein the photothermographic material exhibits not more than 30% of a rate of variation in fog density defined below: Rate of variation in fog density=$[(D_{Fog2}-D_{Fog1})/D_{Fog1}]\times100(\%)$ wherein $D_{Fog1}$ is a minimum density of the photothermographic material that has been subjected to development at a temperature of not less than 100° C. and $D_{Fog2}$ is a minimum density of the photothermographic material that has been subjected to the development and then further subjected to exposure to light at an illumination intensity of 300 lux and a temperature of 45° C. for 24 hrs. The binder preferably has a glass transition point of 70 to 105° C. and is preferably a polyvinyl acetal substantially having an acetoacetal structure or is a polymer compound represented by formula (V). Exemplary polymer compounds represented by formula (V) are disclosed with the composition given in Table 4 below:

TABLE 4

| Polymer | Tg [° C.] | vinyl acetal {mol %/wt %] | vinyl butyral [mol %/wt %] | vinyl alcohol [mol %/wt %] | vinyl acetate [mol %/wt %] |
|---|---|---|---|---|---|
| P-1 | 83 | 51.59/57.4 | 22.11/30.6 | 24.6/10.6 | 1.7/1.4 |
| P-2 | 75 | 22.5/22.9 | 52.5/66.7 | 23.4/9.2 | 1.6/1.2 |
| P-4 | 88 | 49.77/56.5 | 21.33/30.2 | 27.3/12.0 | 1.6/1.3 |
| P-5 | 99 | 64.62/76.0 | 7.18/10.5 | 26.7/12.1 | 1.5/1.4 |
| P-6 | 90 | 57.12/66.0 | 14.28/20.6 | 27.0/12.0 | 1.6/1.4 |
| P-7 | 76 | 21.12/22.3 | 49.28/65.0 | 28.0/11.4 | 1.6/1.3 |
| P-8 | 74 | 23.22/23.2 | 54.18/67.5 | 21.0/8.1 | 1.6/1.2 |

Pioloform™ BL16, a copolymer consisting of 42% by weight of vinyl acetal, 40% by weight of vinyl butyral, 16% by weight of vinyl alcohol and 2% by weight of vinyl acetate having a Tg of 84° C., produced by Wacker Chemie, is used as the sole binder in the thermosensitive element of a substantially light-insensitive thermographic material produced by AGFA-GEVAERT N.V. and marketed by AGFA-GEVAERT N.V. as AGFA FREEWAY™ film and by AUTOLOGIC as Autotype Aspect™ HR. The weight ratio of substantially light-insensitive organic silver salt to Pioloform™ BL16 in this thermosensitive element is approximately 1.0.

Differences Between Substantially Light-insensitive Thermographic Recording Materials and Photothermographic Recording Materials The technology of substantially light-insensitive thermographic materials in which image formation is based on the reduction of organic silver salts is significantly different from that of photothermographic recording materials, despite the fact that in both cases the image results from the reduction of organic silver salts. However, this a superficial similarity masking the fact that the realization of the species which catalyze this reduction is completely different, being image-wise exposure of photosensitive silver halide-containing photo-addressable thermally developable elements in the case of photothermographic recording materials and image-wise heating of thermosensitive elements which do not contain photosensitive silver halide in the case of thermographic recording materials. This difference in technology is further underlined by the nature of the ingredients used in the two types of materials, the most significant difference being the absence of photosensitive silver halide and spectral sensitizing agents in substantially light-insensitive thermographic recording materials, but also reflected in the different reducing agents used, stronger reducing agents being used in substantially light-insensitive thermographic recording materials, the different stabilizers, the different toning agents etc. Furthermore, the thermal development processes themselves are significantly different in that the whole material is heated at temperatures of less than 150° C. for periods of seconds (e.g. 10 s) in the case of photothermographic recording materials, whereas in the case of substantially light-insensitive thermographic recording materials the materials are image-wise heated at much higher temperatures for periods of ms (e.g. 3.5-20 ms). Realization of a neutral image tone is a major problem in the case of substantially light-insensitive thermographic recording materials due to the very short heating times, whereas it is much less of a problem in photothermographic recording materials due to the much longer heating times.

Problem to be Solved

It has been found that, in order to achieve a neutral image tone in substantially light-insensitive monosheet thermographic recording materials, reducing agents and toning agents are required which diffuse to the surface of the material despite the presence of an outermost protective layer both during storage before printing and after printing and results, in extreme cases, in the user visually observing deposits of reducing agents, toning agents and reaction products of the imaging-forming process on the surface of the materials. Substantially light-insensitive monosheet thermographic recording materials are therefore required which exhibit an acceptably neutral image tone, but do not exhibit the formation of such deposits of reducing agents, toning agents and reaction products of the imaging-forming process.

ASPECTS OF THE INVENTION

It is therefore an aspect of the present invention to provide a substantially light-insensitive monosheet thermographic recording material, which does not exhibit the formation of surface deposits comprising, for example, reducing agent, toning agent and reaction products of the image-forming process.

It is therefore a further aspect of the present invention to provide a substantially light-insensitive monosheet thermographic recording material, which does not exhibit the formation of surface deposits and also exhibits an acceptably neutral image tone as characterized by CIELAB a* and b* values determined determined by spectrophotometric measurements according to ASTM Norm E179-90 in a R(45/0) geometry with evaluation according to ASTM Norm E308-90.

Further aspects and advantages of the invention will become apparent from the description hereinafter.

SUMMARY OF THE INVENTION

It has been surprisingly found that the use of a polymer consisting of vinyl aceto-acetal monomer units and optionally monomer units selected from the group consisting of vinyl alcohol and vinyl acetate monomer units in the thermosensitive element of substantially light-insensitive monosheet thermographic recording materials strongly reduces the diffusion of ingredients present therein and reaction products thereof to the surface of the thermosensitive element and therefrom to the surface of the thermographic recording material, should the outermost surface of the thermosensitive element not be the outermost layer of the thermographic recording material itself. Furthermore, it has been surprisingly found that the image tone, as characterized by CIELAB a* and b* values determined by spectrophotometric measurements according to ASTM Norm E179-90 in a R(45/0) geometry with evaluation according to ASTM Norm E308-90, is rendered more neutral the presence of a polymer consisting of vinyl butyral monomer units and optionally vinyl alcohol and/or vinyl acetate monomer units.

Aspects of the present invention are realized with a substantially light-insensitive monosheet thermographic recording material comprising a support and on one side of the support a thermosensitive element, the thermosensitive element comprising at least one substantially light-insensitive silver salt of a carboxylic acid, at least one reducing agent therefor in thermal working relationship therewith and at least one binder, the at least one binder comprising at least one first polymer consisting of vinyl aceto-acetal monomer units and optionally monomer units selected from the group consisting of vinyl alcohol, vinyl acetate and itaconic acid monomer units, wherein the weight ratio of the at least one binder to the light-insensitive silver salt(s) of a carboxylic acid in the thermosensitive element is greater than 1.6; and the at least one binder optionally contains less,than 40% by weight of a second polymer consisting of vinyl butyral monomer units and optionally vinyl alcohol and/or vinyl acetate monomer units.

Preferred embodiments of the present invention are disclosed in the detailed description of the invention.

DETAILED DESCRIPTION OF THE INVENTION

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term poly(vinyl acetals), as used in disclosing the present invention, refers to the condensation product of poly(vinyl alcohol) with one or more aldehydes.

Vinyl acetal, as used in disclosing the present invention, is the condensation product of vinyl alcohol and an aldehyde. To distinguish the condensation product of vinyl alcohol and an aldehyde from that of vinyl alcohol and unsubstituted aldehyde (ethanal), the latter condensation products have been referred to as vinyl aceto-acetal in disclosing the present invention.

Vinyl butyral, as used in disclosing the present invention, is the condensation product of vinyl alcohol and butyraldehyde (butanal), which is not further substituted.

The L*, a* and b* CIELAB-values are defined in ASTM Norm E179-90 in a R(45/0) geometry with evaluation according to ASTM Norm E308-90.

Substantially light-insensitive means not intentionally light sensitive.

The term "high contrast agent", which are sometimes identified as "co-developers" or "auxiliary developers", have as their main function an increase in the contrast of the material by reducing most or all of the reducible silver ions in the substantially light-insensitive silver salt of a carboxylic acid in the radiation-exposed areas e.g. acrylonitrile co-developers, hydrazide co-developers and isoxazole co-developers as disclosed in U.S. Pat. No. 6,352,819 herein incorporated by reference.

Thermographic Recording Material

According to a first embodiment of the thermographic recording material, according to the present invention, the thermographic recording material is a black and white thermographic recording material.

According to a second embodiment of the thermographic recording material, according to the present invention, the thermosensitive element is exclusive of a high contrast agent.

According to a third embodiment of the substantially light-insensitive thermographic recording material, according to the present invention, the thermographic recording material is exclusive of a silane compound represented by formula (1) or (2):

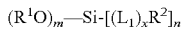

formula (1)

formula (2)

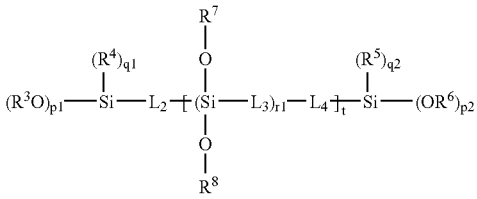

wherein $R^1$, $R^2$, $R^3$, $R^4$, $R^5$, $R^6$, $R^7$ and $R^8$ represent each an alkyl group, an alkenyl group, an alkynyl group, an aryl group or a heterocyclic group; $L_1$, $L_2$, $L_3$ and $L_4$ represent each a bivalent linkage group; m and n are each an integer of t to 3, provided that m+n is 4; p1 and p2 are each an integer of 1 to 3 and q1 and q2 are each 0, 1 or 2, provided that p1+q1 and p2+q2 are each 3; r1 and t are each 0 or an integer of 1 to 1000; and x is 0 or 1.

Thermosensitive Element

The term thermosensitive element as used herein is that element which contains all the ingredients, which contribute to image formation. According to the substantially light-insensitive monosheet thermographic recording material, according to the present invention, the thermosensitive element contains at least a substantially light-insensitive silver salt of a carboxylic acid, a reducing agent therefor in thermal working relationship therewith, and at least one binder. The thermosensitive element may comprise a layer system in which the above-mentioned ingredients may be dispersed in different layers, with the proviso that the substantially light-insensitive silver salt of a carboxylic acid is in reactive association with the reducing agent i.e. during the thermal development process the reducing agent must be present in such a way that it is able to diffuse to the particles of the substantially light-insensitive silver salt of a carboxylic acid, so that reduction to silver can occur. Such materials include the possibility of the substantially light-insensitive silver salt of a carboxylic acid and/or the reducing agent therefor being encapsulated in heat-responsive microcapsules, such as disclosed in EP-A 0 736 799 herein incorporated by reference.

First and Second Polymers

The term first polymer consisting of vinyl aceto-acetal and optionally monomer units selected from the group consisting of vinyl butyral, vinyl alcohol and vinyl acetate monomer units should not be taken as implying that the copolymer has to be produced by copolymerizing vinyl aceto-acetal, vinyl butyral, vinyl alcohol and optionally vinyl acetate, merely that the copolymer consists of such monomer units. Likewise the term second polymer consisting of vinyl butyral monomer units, vinyl alcohol monomer units and optionally vinyl acetate monomer units should not be taken as implying that the copolymer has to be produced by copolymerizing vinyl butyral, vinyl alcohol and optionally vinyl acetate, merely that the copolymer consists of such monomer units. It is well known to one skilled in the art that a main source of polyvinyl alcohol is the hydrolysis of polyvinyl acetate and that this hydrolysis is usually not carried out to completion resulting in vinyl acetate monomer units still being present in the polyvinyl alcohol chains. Furthermore, it is also well known to one skilled in the art that poly(vinyl acetals) are usually produced in a condensation reaction upon treating poly(vinyl alcohol) with one or more aldehydes or directly from poly(vinyl acetate). Since the reaction between the aldehyde(s) and the hydroxyl groups of the poly(vinyl alcohol) occurs at random, some hydroxyl groups become isolated and are incapable of reaction. The product will thus contain: vinyl acetal units, residual vinyl alcohol units and residual vinyl acetate units.

According to a fourth embodiment of the thermographic recording material, according to the present invention, the thermosensitive element contains at least one further first polymer.

According to a fifth embodiment of the thermographic recording material, according to the present invention, the weight ratio of the at least one binder to the light-insensitive silver salt(s) of a carboxylic acid in the thermosensitive element is greater than 1.75, with a ratio greater than 2.0 being particularly preferred and a ratio greater than 2.5 being especially preferred.

According to a sixth embodiment of the thermographic recording material, according to the present invention, the weight ratio of the at least one binder to the light-insensitive silver salt(s) of a carboxylic acid in the thermosensitive element is less than 6.0, with less than 5.2 being preferred and less than 4.5 being particularly preferred.

According to a seventh embodiment of the thermographic recording material, according to the present invention, the first polymer contains ≦17% by weight of vinyl alcohol monomer units, with ≦15% by weight of vinyl alcohol monomer units being preferred and ≦13% by weight being particularly preferred. The concentration of vinyl alcohol units can be determined by $^{13}C$ NMR, or by titration. The vinyl aceto-acetal monomer units render the image tone red, but this can be compensated by reducing the vinyl alcohol concentration, which renders the image tone blue.

Suitable first polymers for use in substantially light-insensitive thermographic recording materials, according to the present invention, in which AB represents polymers containing both vinyl aceto-acetal and vinyl butyral monomer units and A represents polymers containing vinyl aceto-acetal monomer units but no vinyl butyral monomer units are given in table 5 below:

TABLE 5

| Polymer No. | Tg [° C.] | vinyl aceto-acetal {mol %/wt %] | vinyl alcohol [mol %/wt %] | vinyl acetate [mol %/wt %] | itaconic acid [mol %/wt %] |
|---|---|---|---|---|---|
| A01# | 109.7 | 70/84* | 27/13* | 1/1* | 2/2 |
| A02 | 110.5 | 73.0/87.0 | 25.7/11.8 | 1.3/1.2 | — |
| A03 | 111.7 | 71.6/86.3 | 27.3/12.7 | 1.1/1.0 | — |
| A04 | 78.9 | 61/79* | 37/19* | 2/2* | — |

TABLE 5-continued

| Polymer No. | Tg [° C.] | vinyl aceto-acetal {mol %/wt %] | vinyl alcohol [mol %/wt %] | vinyl acetate [mol %/wt %] | itaconic acid [mol %/wt %] |
|---|---|---|---|---|---|
| A05 | 85.2 | 69/85* | 30/14* | 1/1* | — |
| A06 | 84.6 | 69/85* | 30/14 | 1/1* | — |
| A07 | 86.8 | 69/85* | 29/14 | 2/2* | — |

#S-LEC ® KS-1 from Sekisui which contains 2.0 wt % itaconic acid
*from $^{13}C$ NMR measurements Suitable second polymers for use in substantially light-insensitive thermographic recording materials, according to the present invention, in which B represents polymers containing vinyl butyral monomer units but no vinyl aceto-acetal monomer units are given in the Table 6 below:

TABLE 6

| Polymer No. | Tg [° C.] | vinyl aceto-acetal {mol %/wt %] | vinyl butyral [mol %/wt %] | vinyl alcohol [mol %/wt %] | vinyl acetate [mol %/wt %] |
|---|---|---|---|---|---|
| B01 | 66.8 | 0/0 | 63.3/84.0 | 34.5/14.2 | 2.2/1.8 |
| B02 | — | 0/0 | 62.9/83.8 | 34.9/14.4 | 2.2/1.8 |
| B03 | 63.4 | 0/0 | 63.8/84.0 | 33.1/13.5 | 3.1/2.5 |
| B04 | 62-72 | 0/0 | 70.3/88.0 | 28.4/11.0 | 1.3/1.0 |
| B05 | 65 | 0/0 | 63.7/84.4 | 34.4/14.1 | 1.9/1.5 |
| B06 | 67 | 0/0 | 56.6/80.0 | 41.1/18.0 | 2.3/2.0 |
| B07 | 66 | 0/0 | 56.6/80.0 | 41.1/18.0 | 2.3/2.0 |

Polymers are preferred which do not contain additives, such as certain antioxidants (e.g. 2,6-di-tert-butyl-4-methylphenol), or impurities, which adversely affect the thermographic properties of the thermographic recording materials in which they are used.

Substantially Light-insensitive Silver Salt of a Carboxylic Acid

According to an eighth embodiment of the thermographic recording material, according to the present invention, the substantially light-insensitive silver salt of a carboxylic acid is not a double organic salt containing a silver cation associated with a second cation e.g. magnesium or iron ions.

According to a ninth embodiment of the thermographic recording material, according to the present invention, the substantially light-insensitive silver salt of an carboxylic acid is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salts of an organic carboxylic acids may also be used in the present invention, as disclosed in EP-A 964 300 herein incorporated by reference.

Reducing Agent

According to a tenth embodiment of thermographic recording material, according to the present invention, the reducing agent is an ortho-dihydroxy-benzene derivative.

According to an eleventh embodiment of the thermographic recording material, according to the present invention, the ortho-dihydroxy-benzene derivative is selected from the group consisting of catechol, 3-(3,4-dihydroxyphenyl)propionic acid, 3,4-dihydroxybenzoic acid, 3,4-dihydroxybenzoic acid esters, gallic acid, gallic acid esters, e.g. methyl gallate, ethyl gallate and propyl gallate, 3,4-dihydroxy-benzaldehyde, 3,4-dihydroxy-acetophenone, 3,4-butyrophenone, 3,4-dihydroxy-benzophenone, 3,4-dihydroxy-benzophenone derivatives, 3,4-dihydroxy-benzonitrile, and tannic acid, as disclosed in EP-A 0 692 733, EP-A 0 903 625, EP-A 1 245 403 and EP-A 1 245 404 herein incorporated by reference.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Toning Agent

According to a twelfth embodiment of the thermographic recording material, according to the present invention, the thermosensitive element further contains at least one toning agent.

According to a thirteenth embodiment of the thermographic recording material, according to the present invention, the at least one toning agent is selected from the group consisting of phthalazinone, phthalazinone derivatives, benzoxazine dione, benzoxazine dione derivatives, naphthoxazine dione and naphthoxazine derivatives, pyridazone, pyridazone derivatives, compounds represented by formula (I):

(I)

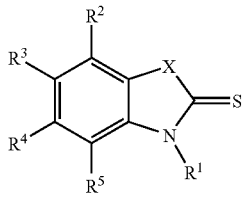

wherein $R^1$ is an alkyl group optionally substituted with a hydroxy, carboxy, carboxy ester, acyl or carbonato group; X is S, O or N—$R^6$; $R^6$ is an optionally substituted alkyl group; $R^2$, $R^3$, $R^4$ and $R^5$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or at least one of $R^2$ and $R^3$, $R^3$ and $R^4$ and $R^4$ and $R^5$ independently represent the atoms necessary to form a carbocyclic or heterocyclic group or at least one of $R^1$ and $R^5$ and $R^2$ and $R^6$ independently represent the atoms necessary to form a heterocyclic ring; compounds represented by formula (II):

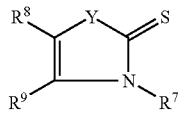

(II)

wherein $R^7$ is an optionally substituted alkyl group; Y is S, O or N—$R^{10}$; $R^{10}$ is an optionally substituted alkyl group; $R^8$ and $R^9$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or $R^8$ and $R^9$ represent the atoms necessary to form a heterocyclic or a non-aromatic carbocyclic ring or at least one of $R^8$ and $R^{10}$ and $R^9$ and $R^7$ independently represent the atoms necessary to form a heterocyclic ring; and both $R^8$ and $R^9$ cannot both be an alkyl group; and 2-hydroxy-pyrimidine and 2-hydroxy-pyrimidine derivatives.

Suitable optional substituents for the alkyl groups of $R^1$, $R^6$, $R^7$ and $R^{10}$ are independently include carboxy and carboxy ester groups. Suitable substituted alkyl groups include: —$CH_2COOH$, —$C_2H_4COOH$ and —$C_2H_4COOC_2H_5$.

Suitable benzoxazine dione toning agents for use in the thermographic recording material, according to the present invention, are disclosed in GB 1,439,478, U.S. Pat. No. 3,951,660 and U.S. Pat. No. 5,599,647, herein incorporated by reference, and include:

| BOD-nr. | |
|---|---|
| BOD01 | 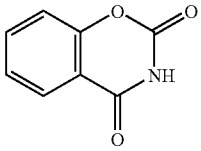 |
| BOD02 | 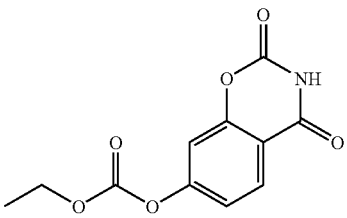 |
| BOD03 | 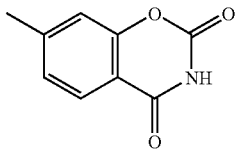 |
| BOD04 | 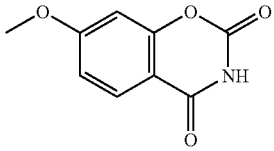 7-methoxy-benzo[e][1,3]oxazine-2,4-dione |

-continued

| BOD-nr. | |
|---|---|
| BOD05 | 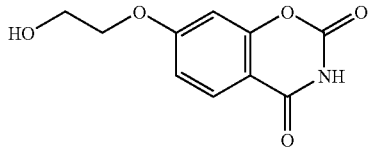 |
| BOD06 | 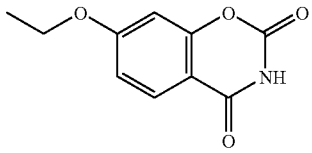 7-ethoxy-benzo[e][1,3]oxazine-2,4-dione |
| BOD07 | 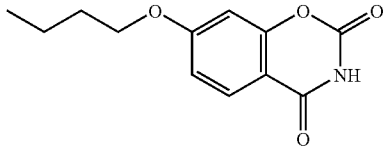 7-butoxy-benzo[e][1,3]oxazine-2,4-dione |
| BOD08 | 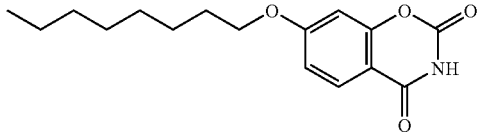 7-octoxy-benzo[e][1,3]oxazine-2,4-dione |
| BOD09 | 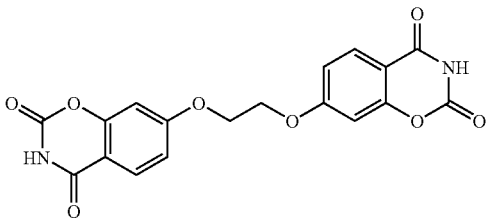 |
| BOD10 | 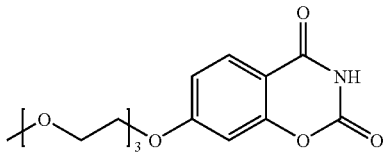 |
| BOD11 | 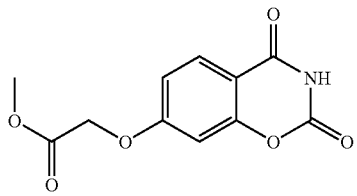 |
| BOD12 | 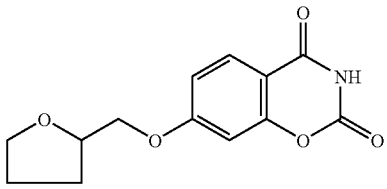 |

-continued

| BOD-nr. | |
|---|---|
| BOD13 | 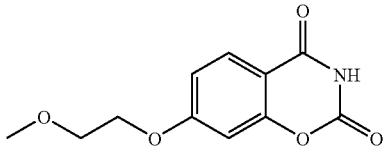 |
| BOD14 | 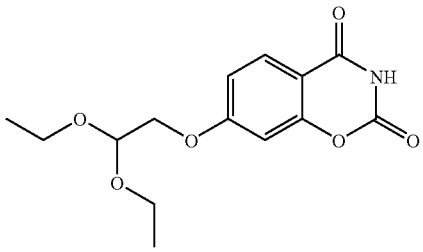 |

Suitable toning agents represented by formula (I) for use in the thermographic recording material, according to the present invention, include:

| toning agent nr. | |
|---|---|
| TA-I-1 | 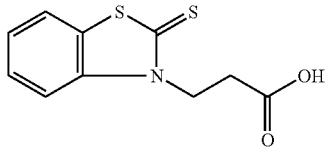 |
| TA-I-2 | 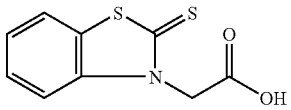 |
| TA-I-3 | 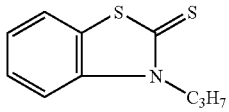 |
| TA-I-4 | 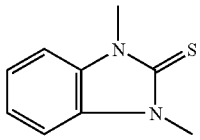 |
| TA-I-5 | 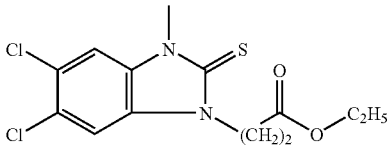 |

-continued

| toning agent nr. | |
|---|---|
| TA-I-6 | 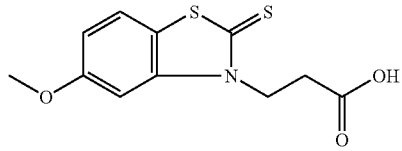 |
| TA-I-7 | 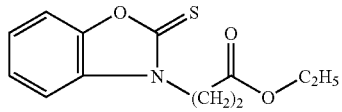 |
| TA-I-8 | 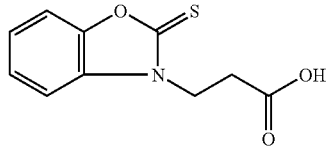 |
| TA-I-9 | 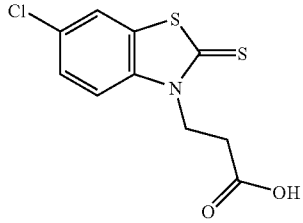 |
| TA-I-10 | 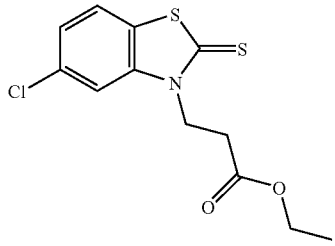 |
| TA-I-11 | 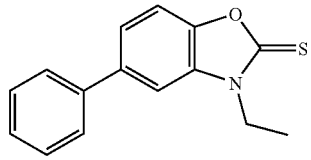 |

Suitable toning agents represented by formula (II) according to the present invention include:

| toning agent nr. | |
|---|---|
| TA-II-1 | 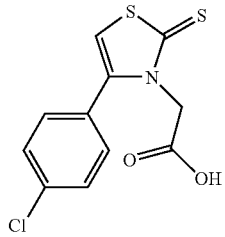 |

-continued

| toning agent nr. | |
|---|---|
| TA-II-2 | 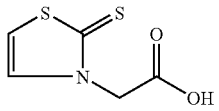 |
| TA-II-3 | 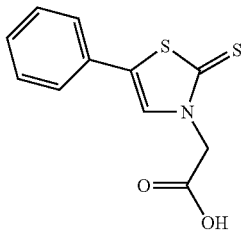 |
| TA-II-4 | 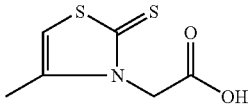 |
| TA-II-5 | 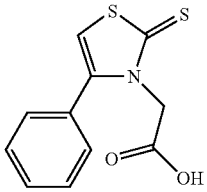 |
| TA-II-6 | 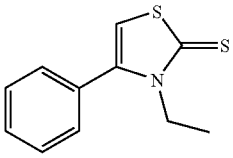 |
| TA-II-7 | 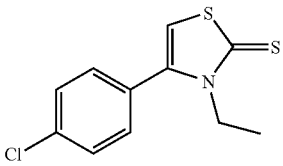 |

Suitable 2-hydroxy-pyrimidine derivatives, according to the present invention, include:

| toning agent nr. | |
|---|---|
| TA-III-1 | 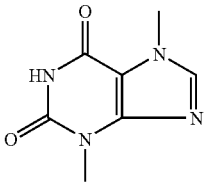 3,7-dimethyl-xanthine (theobromine) |
| TA-III-2 | 1,7-dimethyl-xanthine (paraxanthine) |
| TA-III-3 | xanthine (2,6-dihydroxy-purine) |
| TA-III-4 | 2,6,8-trihydroxy-purine (uric acid) |
| TA-III-5 | 1,3-dimethyl-uric acid |
| TA-III-6 | 2,4-dihydroxy-pyrimidine (uracil) |

-continued

| toning agent nr. | |
|---|---|
| TA-III-7 | thymine (5-methyl-uracil) |
| TA-III-8 | 2-mercaptopyrimidine |
| TA-III-9 | alloxan [2,4,5,6(1H,3H)-pyrimidinetetrone] |
| TA-III-10 | alloxazine [benzo[g]pteridine-2,4(1H,3H)-dione] |
| TA-III-11 | 2,4-dihydroxy-pyrimidine-6-carboxylic acid (orotic acid) |
| TA-III-12 | 2,4-dihydroxy-pyrimidine-5-carboxylic acid |
| TA-III-13 | 2,4-dihydroxy-5-methyl-pyrimidine (thymine) |
| TA-III-14 | 2,4,6-trihydroxy-pyrimidine (barbituric acid) |
| TA-III-15 | 2,4,5-trihydroxy-pyrimidine (isobartituric acid) |
| TA-III-16 | diethyl-barbituric acid |

Protective Layer

In general the outermost protective layer protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics is during transport past the heat source during heating. A slipping layer, being the outermost layer, may comprise a dissolved lubricating material and/or particulate material, e.g. talc particles, optionally protruding from the outermost layer. Examples of suitable lubricating materials are a surface-active agent, a liquid lubricant, a solid lubricant or mixtures thereof, with or without a polymeric binder.

According to a fourteenth embodiment of the substantially light-insensitive monosheet thermographic recording material, according to the present invention, the outermost protective layer comprises the reaction product of at least one hydrolyzed polyalkoxysilane and a hydroxy-group containing polymer.

According to a fifteenth embodiment of the substantially light-insensitive monosheet thermographic recording material, according to the present invention, the outermost protective layer comprises the reaction product of hydrolyzed tetramethoxysilane or tetraethoxysilane and a hydroxy-group containing polymer.

According to a fifteenth embodiment of the substantially light-insensitive monosheet thermographic recording material, according to the present invention, the outermost protective layer comprises the reaction product of at least one hydrolyzed polyalkoxysilane and poly(vinyl alcohol).

Stabilizers

According to a sixteenth embodiment of the substantially light-insensitive monosheet thermographic recording material, according to the present invention, the thermosensitive element further contains a stabilizer.

According to a seventeenth embodiment of the substantially light-insensitive monosheet thermographic recording material, according to the present invention, the thermosensitive element further contains a stabilizer selected from the group consisting of benzotriazole; substituted benzotriazoles; aromatic polycarboxylic acid, such as ortho-phthalic acid, 3-nitro-phthalic acid, tetrachlorophthalic acid, mellitic acid, pyromellitic acid and trimellitic acid and anhydrides thereof; 1-phenyl-5-mercapto-tetrazole compounds in which the phenyl group is substituted with a substituent containing an optionally substituted aryl group, 1-(5-mercapto-1-tetrazolyl)-acetyl compounds represented by formula (III):

(III)

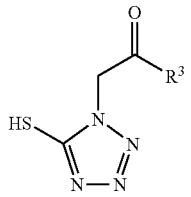

wherein $R^3$ is —$NR^4R^5$, —$OR^6$ or an optionally substituted aryl or heteroaryl group; $R^4$ is hydrogen or an optionally substituted alkyl, aryl or heteroaryl group; $R^5$ is an optionally substituted aryl or heteroaryl group; and $R^6$ is an optionally substituted aryl group; and compounds with two or more groups represented by formula (IV):

(IV)

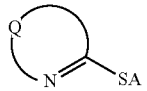

where Q comprises the necessary atoms to form a 5- or 6-membered unsaturated heterocyclic ring, A is hydrogen, a counterion to compensate the negative charge of the thiolate group or two or more A groups provide a linking group between the two or more groups represented by formula (IV).

According to an eighteenth embodiment of the substantially light-insensitive monosheet thermographic recording material, according to the present invention, the thermosensitive element further contains at least one optionally substituted aliphatic or carbocyclic polycarboxylic acid and/or anhydride thereof in a molar percentage of at least 15 with respect to all the organic silver salt(s) present and in thermal working relationship therewith. The polycarboxylic acid may be used in anhydride form or partially esterified on the condition that at least two free carboxylic acids remain or are available during the heat recording step.

Surfactants and Dispersants

Surfactants and dispersants aid the dispersion of ingredients, which are insoluble in the particular dispersion medium. The substantially light-insensitive thermographic recording material used in the present invention may contain one or more surfactants, which may be anionic, non-ionic or cationic surfactants and/or one or more dispersants. Preferred anionic surfactants are surfactants represented by formula (3):

(3)

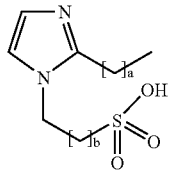

or alkali salts thereof, where a is an integer between 1 and 15; and b is an integer between 1 and 5; and surfactants represented by formula (4):

(I)

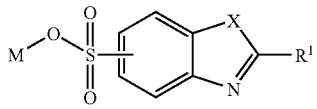

wherein M is hydrogen, an alkali atom or an ammonium group; $R^1$ is an alkyl, alkenyl-, alkynyl-, thioalkyl-, thioalkenyl- or thioalkynyl-group in which the alkyl-, alkenyl- or alkynyl-group has 6 to 25 carbon atoms; X is —O—, —S— or —$N(R^2)$—; and $R^2$ is hydrogen, a —$(CH_2)_mSO_3M$ group or a

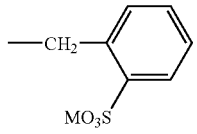

group; and m is an integer between 1 and 5.

Suitable surfactants include:

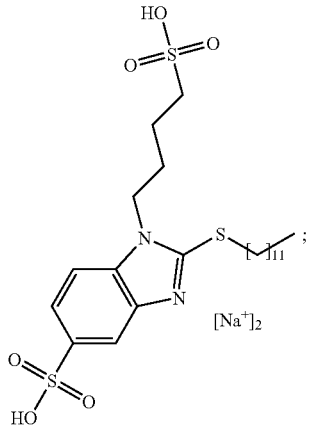

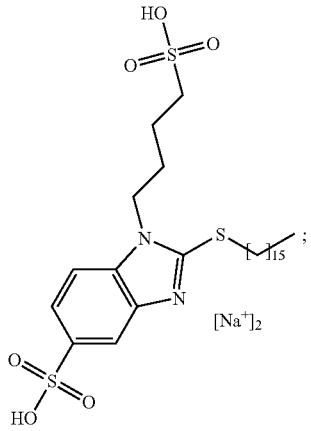

-continued

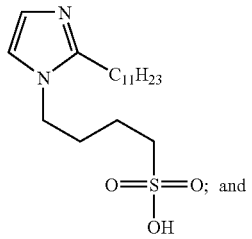

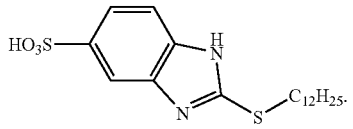

Suitable dispersants are natural polymeric substances, synthetic polymeric substances and finely divided powders, e.g. finely divided non-metallic inorganic powders such as silica.

Support

According to a nineteenth embodiment of the substantially light-insensitive monosheet thermographic recording material, according to the present invention, the support is transparent or translucent. It is preferably a thin flexible carrier made of transparent resin film, e.g. made of a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated thermosensitive element. The support may be dyed or pigmented to provide a transparent coloured background for the image.

Coating Techniques

The coating of any layer of the substantially light-insensitive thermographic recording material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic recording material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200-1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Ingredients in the Thermosensitive Element in Addition to the Above-mentioned Ingredients:

Oil=BAYSILON, a silicone oil from BAYER;

VL=DESMODUR VL, a 4,4'-diisocyanatodiphenylmethane from BAYER

Reducing Agents:

R01=3,4-dihydroxybenzonitrile;

R02=3,4-dihydroxybenzophenone;

Stabilizers:

S01 = glutaric acid

S02 = tetrachlorophthalic acid anhydride

S03 = benzotriazole

S04 =

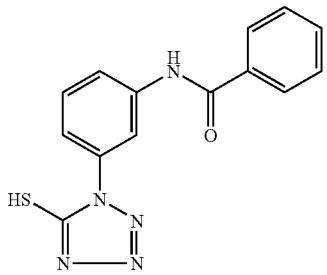

Compositions of Thermosensitive Elements Used:

| | Thermosensitive element types | | | | | |
|---|---|---|---|---|---|---|
| | 1 | 2 | 3 | 4 | 5 | 6 |
| Binder/AgBeh by weight | 4 | 4 | 4 | 3.6 | 3.6 | 4 |
| R01 [mol % vs AgBeh] | 50 | 35 | 35 | 25 | 35 | 35 |
| R02 [mol % vs AgBeh] | 30 | 45 | 45 | 40 | 40 | 45 |
| BOD02 [mol % vs AgBeh] | 5 | — | — | — | — | — |
| BOD03 [mol % vs AgBeh] | 10 | 15 | 15 | — | — | 15 |
| BOD04 [mol % vs AgBeh] | — | — | — | 15 | 15 | — |
| S01 [mol % vs AgBeh] | 22 | 24 | 27 | 28 | 30 | 26 |
| S02 [mol % vs AgBeh] | 5 | 5 | 5 | 5 | 5 | 5 |
| S03 [mol % vs AgBeh] | 10 | 10 | 3 | — | 2.5 | 5 |
| S04 [mol % vs AgBeh] | — | — | 3 | 5 | 2.5 | — |
| VL [g/m$^2$] | 0.175 | 0.175 | 0.175 | 0.175 | 0.175 | 0.175 |
| Oil [g/m$^2$] | 0.033 | 0.033 | 0.033 | 0.033 | 0.033 | 0.033 |

Ingredients in the Protective Layer:

| | |
|---|---|
| ERKOL ™ 48 20 = | a polyvinylalcohol from ACETEX EUROPE; |
| LEVASIL ™ VP AC 4055 = | a 15% aqueous dispersion of colloidal silica with acid groups predominantly neutralized with sodium ions and a specific surface area of 500 m$^2$/g, from BAYER AG was converted into the ammonium salt; |
| ULTRAVON ™ W = | 75-85% concentrate of a sodium aryl-sulfonate from Ciba Geigy converted into acid form by passing through an ion exchange column; |
| SYLOID ™ 72 = | a silica from Grace; |
| SERVOXYL ™ VPDZ 3/100 = | a mono[isotridecyl polyglycolether (3 EO)] phosphate, from SERVO DELDEN B.V.; |
| SERVOXYL ™ VPAZ 100 = | a mixture of monolauryl and dilauryl phosphate, from SERVO DELDEN B.V.; |
| MICROACE TALC P3 = | an Indian talc from NIPPON TALC; |
| RILANIT ™ GMS = | a glycerine monotallow acid ester, from HENKEL AG |
| TMOS = | tetramethylorthosilicate hydrolyzed in the presence of methanesulfonic acid. |

COMPARATIVE EXAMPLES 1 to 4

The substantially light-insensitive thermographic recording materials of COMPARATIVE EXAMPLES 1 to 4 were prepared by coating a dispersion prepared as follows: a first solution containing 25.42 g methylethylketone, 12.375 g of binder and 33 mg Oil (Baysilon) was prepared. To this solution 36.8 g of a AgBehenate-dispersion, containing per 100 g dispersion 10.7 g of AgBehenate and 9.35 g of binder, was added. Then 0.257 g of S01, 0.116 g of BOD2 and 0.164 g of BOD3 was added. This was followed by the addition of 9.4 g of a solution containing 0.567 g R02, 0.596 g R01, 0.126 g S02 and 0.100 g S03 in methylethylketone. Finally 2.2 g of a 8 wt % Desmodur VL solution in methylethylketon was added. The resulting dispersion was doctor blade-coated onto a subbed 175 μm thick blue-pigmented polyethylene terephthalate support with CIELAB a*- and b*-values of −9.5 and −17.9 respectively subbed on the emulsion-coated side with subbing layer 01 giving type 1 thermosensitive elements with the composition given above, after drying at 50° C. for 1 h in a drying cupboard.

The coverage of silver behenate and the quantities and types of polymers used in the thermosensitive elements are given in Table 7 below.

TABLE 7

| | | Binder in AgBeh dispersion | | Added binder | | | Haze |
|---|---|---|---|---|---|---|---|
| Comparative example nr. | AgBeh [g/m$^2$] | Polymer type | quantity [wt ratio vs AgBeh] | Polymer type | quantity [wt ratio vs AgBeh] | Assessment of diffusion | thermosensitive element [%] |
| 1 | 3.77 | B01 | 0.87 | B01 | 3.13 | 5 | 22.1 |
| 2 | 3.95 | B01 | 0.87 | B04 | 3.13 | 5 | 22.8 |
| 3 | 4.21 | B01 | 0.87 | B05 | 3.13 | 5 | 22.7 |
| 4 | 4.14 | B01 | 0.87 | B07 | 3.13 | 5 | 19.6 |

The thermosensitive elements were then optionally coated with an aqueous composition with the following ingredients, which was adjusted to a pH of 3.8 with 1N nitric acid, to a wet layer thickness of 85 μm and then dried at 50° C. for 15 minutes to produce a protective layer with the composition:

| | | |
|---|---|---|
| ERKOL ™ 48 20 = | 2.1 | $g/m^2$ |
| LEVASIL ™ VP AC 4055 = | 1.05 | $g/m^2$ |
| ULTRAVON ™ W = | 0.075 | $g/m^2$ |
| SYLOID ™ 72 = | 0.09 | $g/m^2$ |
| SERVOXYL ™ VPDZ 3/100 = | 0.075 | $g/m^2$ |
| SERVOXYL ™ VPAZ 100 = | 0.075 | $g/m^2$ |
| MICROACE TALC P3 = | 0.045 | $g/m^2$ |
| RILANIT ™ GMS = | 0.15 | $g/m^2$ |
| TMOS = | 0.87 | $g/m^2$ (assuming that the TMOS was completely converted to $SiO_2$) |

After coating the protective layer was hardened by heating the substantially light-insensitive thermographic recording material at 45° C. for 7 days at a relative humidity of 70%.

Haze Measurements

The haze of the thermosensitive elements of the thermographic recording materials of COMPARATIVE EXAMPLES 1 to 4 was determined as a percentage according to ASTM standard D1003 using a Haze-gard Plus apparatus from BYK GARDNER according to the expression:

$$\text{Haze, \%}=(T_d/T_t)\times 100$$

where $T_d$ is the diffuse luminous transmittance and $T_t$ is the total luminous transmittance.

Assessment of Diffusion of Ingredients and Reaction Products of the Imaging Forming Process to the Surface of Thermosensitive Element The diffusion of ingredients and reaction products of the imaging forming process to the surface of the thermosensitive element was assessed by:

first thermographically printing the thermosensitive elements of COMPARATIVE EXAMPLES 1 to 4 using a DRYSTAR™ 4500 printer from AGFA-GEVAERT with a resolution of 508 dpi which has been modified to operate at a printing speed of 14 mm/s and a line-time of 3.5 ms instead of 7.1 ms and in which the 75 μm long (in the transport direction) and 50 μm wide thermal head resistors were power-modulated to produce different image densities during which the print head was separated from the imaging layer by a thin intermediate material. This intermediate material is a separable 5 μm thick polyethylene terephthalate ribbon coated with the same composition as the above-described protective later. (This was necessary to protect the thermal head from direct contact with the outermost surface of the thermosensitive element);

then removing the thin intermediate material and subjecting the thermosensitive element to 3 days wrapped in black paper in the dark at a temperature of 57° C. and 34% relative humidity; and finally visually assessing the diffusion of the ingredients therein and reaction products thereof to the surface according to a scale of 0 to 5 with the following criteria:

| | |
|---|---|
| diffusion assessment of 0: | no diffusion |
| diffusion assessment of 1: | first indication of diffusion upon examination under an intense lighting after rubbing with a paper tissue |
| diffusion assessment of 2: | visible in daylight after rubbing with a paper tissue |
| diffusion assessment of 3: | just visible in daylight without rubbing with a paper tissue |
| diffusion assessment of 4: | moderately strong deposition without rubbing with a paper tissue |
| diffusion assessment of 5: | very strong deposition without rubbing with a paper tissue |

The results are summarized in Table 7. In the presence of 21.75% by weight of B01, B04 and B05 have no effect on the diffusion of ingredients and reaction products thereof, whereas B02 and B07 have a marginal effect on the diffusion of ingredients and reaction products thereof.

Thermographic Printing

The substantially light-insensitive thermographic recording materials of COMPARATIVE EXAMPLES 1 to 4 were printed using the above-mentioned modified DRYSTAR™ 4500 printer from AGFA-GEVAERT to produce different image densities. The maximum densities of the images ($D_{max}$) measured through a visible filter with a MACBETH™ TR924 densitometer were all greater than 2.0. The CIELAB a*- and b*-values for densities of 1.0 and 2.0 were determined by spectrophotometric measurements according to ASTM Norm E179-90 in a R(45/0) geometry with evaluation according to ASTM Norm E308-90. The results are summarized in Table 8.

TABLE 8

| Comparative example nr. | dispersion polymer/ added polymer | CIELAB values for fresh film for D = 1.0 | | CIELAB values for fresh film for D = 2.0 | |
|---|---|---|---|---|---|
| | | a* | b* | a* | b* |
| 1 | B01/B01 | −3.86 | −6.15 | −1.2 | −5.38 |
| 2 | B01/B04 | −3.74 | −6.42 | −0.93 | −5.69 |
| 3 | B01/B05 | −3.62 | −5.15 | −0.1 | −3.88 |
| 4 | B01/B07 | −3.1 | −6.32 | −0.31 | −5.85 |

COMPARATIVE EXAMPLES 5 AND 6 AND INVENTION EXAMPLES 1 to 3

The substantially light-insensitive thermographic recording materials of COMPARATIVE EXAMPLES 5 and 6 and INVENTION EXAMPLES 1 to 3 were prepared by coating a dispersion prepared as follows: a first solution containing 37.44 g methylethylketone, 12.375 g of binder and 33 mg Oil (Baysilon) was prepared. To this solution 28.35 g of a AgBehenate-dispersion, containing per 100 g dispersion 14 g of AgBehenate and 12.1 g of binder, was added. Then 0.280 g of S01 and 0.246 g of BOD3 was added. This was followed by the addition of 7.5 g of a solution containing 0.850 g R02, 0.417 g R01, 0.126 g S02 and 0.100 g S03 in methylethylketone. Finally 2.2 g of a 8 wt % Desmodur VL solution in methylethylketon was added. The resulting dispersion was doctor blade-coated onto a subbed 175 μm thick blue-pigmented polyethylene terephthalate support with CIELAB a*- and b*-values of −9.5 and −17.9 respectively subbed on the emulsion-coated side with subbing layer 01 giving type 2 thermosensitive elements with the composition given above, after drying at 50° C. for 1 h in a drying cupboard.

The coverage of silver behenate and the quantities and types of polymers used in the thermosensitive elements are given in Table 9 below.

The diffusion through the thermosensitive elements was assessed as described for the thermosensitive elements of COMPARATIVE EXAMPLES 1 to 4 and the results are summarized in Table 9. In the presence of 21.75% by weight of B01, A03 and A01 have a fair effect on the diffusion of ingredients and reaction products thereof and A02 has a strong effect on the diffusion of ingredients and reaction products thereof in the substantially light-insensitive thermographic recording material of the present invention.

TABLE 9

| | | Binder in AgBeh dispersion | | Added binder | | |
|---|---|---|---|---|---|---|
| | AgBeh [g/m$^2$] | Polymer type | quantity [wt ratio vs AgBeh] | Polymer type | quantity [wt ratio vs AgBeh] | Assessment of diffusion |
| Comparative example nr | | | | | | |
| 5 | 4.00 | B01 | 0.87 | B01 | 3.13 | 5 |
| 6 | 4.29 | B01 | 0.87 | B03 | 3.13 | 5 |
| Invention example nr | | | | | | |
| 1 | 3.98 | B01 | 0.87 | A01 | 3.13 | 3 |
| 2 | 3.77 | B01 | 0.87 | A02 | 3.13 | 2 |
| 3 | 3.64 | B01 | 0.87 | A03 | 3.13 | 4 |

The thermosensitive elements of COMPARATIVE EXAMPLES 5 and 6 and INVENTION EXAMPLES 1 to 3 were further coated with a protective layer as described for the substantially light-insensitive thermographic recording materials of COMPARATIVE EXAMPLES 1 to 4 and the image tone of the fresh thermographic recording materials determined as described for COMPARATIVE EXAMPLES 1 to 7 and INVENTION EXAMPLES 1 and 2, the results being summarized in Table 10.

With thermosensitive element type 2, the most neutral image tone is exhibited by the thermographic recording material of INVENTION EXAMPLE 3 with second polymer B01 as the dispersion polymer and first polymer A03 as the added polymer.

TABLE 10

| | dispersion polymer/ | CIELAB values for fresh film for D = 1.0 | | CIELAB values for fresh film for D = 2.0 | |
|---|---|---|---|---|---|
| | added polymer | a* | b* | a* | b* |
| Comparative example nr. | | | | | |
| 5 | B01/B01 | −2.7 | −8.4 | +0.4 | −5.9 |
| 6 | B01/B03 | −2.7 | −7.9 | +0.3 | −4.4 |

TABLE 10-continued

| | dispersion polymer/ | CIELAB values for fresh film for D = 1.0 | | CIELAB values for fresh film for D = 2.0 | |
|---|---|---|---|---|---|
| | added polymer | a* | b* | a* | b* |
| Invention example nr | | | | | |
| 1 | B01/A01 | +3.6 | −0.3 | +4.5 | −3.7 |
| 2 | B01/A02 | +4.2 | +0.7 | +5.0 | −2.7 |
| 3 | B01/A03 | +3.3 | −1.7 | +3.9 | −4.5 |

COMPARATIVE EXAMPLES 7 AND 8 AND INVENTION EXAMPLES 4 AND 5

The substantially light-insensitive thermographic recording materials of COMPARATIVE EXAMPLES 7 and 8 and INVENTION EXAMPLES 4 and 5 were prepared by coating a dispersion prepared as follows: a first solution containing 28.0 g methylethylketone, 13 g of binder and 33 mg Oil (Baysilon) was prepared. To this solution 36.3 g of a AgBehenate-dispersion, containing per 100 g dispersion 11.4 g of AgBehenate and 9.9 g of binder, was added. Then 0.246 g BOD3 was added. This was followed by the addition of 7.9 g of a solution containing 0.894 g R02, 0.438 g R01, 0.130 g S02, 0.033 g S03, 0.082 g S04 and 0.331 g S01 in methylethylketone. Finally 2.2 g of a 8 wt % Desmodur VL solution in methylethylketon was added. The resulting dispersion was doctor blade-coated onto a subbed 175 μm thick blue-pigmented polyethylene terephthalate support with CIELAB a*- and b*-values of −9.5 and −17.9 respectively subbed on the emulsion-coated side with subbing layer 01 giving type 3 thermosensitive elements with the composition given above, after drying at 50° C. for 1 h in a drying cupboard.

The coverage of silver behenate and the quantities and types of polymers used in the thermosensitive elements are given in Table 11 below.

TABLE 11

| | | first polymer vs AgBeh] | | Added binder | | quantity | |
|---|---|---|---|---|---|---|---|
| | AgBeh [g/m$^2$] | Polymer type | quantity [wt ratio vs AgBeh] | Polymer type | quantity [wt ratio vs AgBeh] | [wt ratio of first polymer vs AgBeh] | Assessment of diffusion |
| Comparative example nr. | | | | | | | |
| 7 | 4.06 | B01 | 0.87 | B01 | 3.13 | — | 5 |
| 8 | 4.11 | B01 | 0.87 | 50% A03 50% B01 | 3.13 | 1.565 | 5 |
| Invention example nr. | | | | | | | |
| 4 | 4.16 | B01 | 0.87 | A03 | 3.13 | 3.13 | 3 |
| 5 | 4.14 | B01 | 0.87 | A02 | 3.13 | 3.13 | 3 |

The diffusion through the thermosensitive elements was assessed as described for the thermosensitive elements of COMPARATIVE EXAMPLES 1 to 4 and the results are summarized in Table 11. The A03 has an effect at a concentration in the at least one binder between 39% by weight and 78% by weight. The A02 has an effect at a concentration in the at least one binder of <<78% by weight.

The thermosensitive elements of COMPARATIVE EXAMPLES 7 and 8 and INVENTION EXAMPLES 4 and 5 were further coated with a protective layer as described for the substantially light-insensitive thermographic recording materials of COMPARATIVE EXAMPLES 1 to 4 and the image tone of the fresh thermographic recording materials determined as described for COMPARATIVE EXAMPLES 1 to 7 and INVENTION EXAMPLES 1 and 2, the results being summarized in Table 12.

TABLE 12

| | dispersion polymer/ added polymer | fresh film CIELAB values for D = 1.0 | | fresh film CIELAB values for D = 2.0 | |
|---|---|---|---|---|---|
| | | a* | b* | a* | b* |
| Comparative example nr | | | | | |
| 7 | B01/B01 | −2.7 | −8.3 | −0.4 | −5.9 |
| 8 | B01/50% B01 + 50% A03 | −1.6 | −4.5 | +1.1 | −3.6 |
| Invention example nr | | | | | |
| 4 | B01/A03 | +2.9 | +0.8 | +3.5 | −0.6 |
| 5 | B01/A02 | +1.7 | 0.0 | +3.9 | −0.2 |

The thermographic recording materials of INVENTION EXAMPLES 4 and 5 with thermosensitive element type 3 with second polymer B01 as the dispersion polymer the image tone neutrality increased in the order of first polymers as added polymer: A03<A02.

COMPARATIVE EXAMPLE 9 AND INVENTION EXAMPLES 6 TO 8

The substantially light-insensitive thermographic recording materials of COMPARATIVE EXAMPLE 9 and INVENTION EXAMPLES 6 to 8 were prepared by coating a dispersion prepared as follows: a first solution containing 36.6 g methylethylketone, 12.50 g of binder and 33 mg Oil (Baysilon) was prepared. To this solution 32.8 g of a AgBehenate-dispersion, containing per 100 g dispersion 12.7 g of AgBehenate and 11 g of binder, was added. Then 0.247 g BOD3 and 0.320 g S01 was added. This was followed by the addition of 7.52 g of a solution containing 0.896 g R02, 0.438 g R01, 0.130 g S02 and 0.055 g S03 in methylethylketone. Finally 2.2 g of a 8 wt % Desmodur VL solution in methylethylketon was added. The resulting dispersion was doctor blade-coated onto a subbed 175 μm thick blue-pigmented polyethylene terephthalate support with CIELAB a*- and b*-values of −9.5 and −17.9 respectively subbed on the emulsion-coated side with subbing layer 01 giving type 6 thermosensitive elements with the composition given above, after drying at 50° C. for 1 h in a drying cupboard.

The coverage of silver behenate and the quantities and types of polymers used in the thermosensitive elements are given in Table 13 below.

TABLE 13

| | AgBeh [g/m²] | Binder in AgBeh dispersion: Polymer type | Binder in AgBeh dispersion: quantity [wt ratio vs AgBeh] | Added binder: Polymer type | Added binder: quantity [wt ratio vs AgBeh] | quantity [wt ratio of first polymer vs AgBeh] | Assessment of diffusion |
|---|---|---|---|---|---|---|---|
| Comparative example nr | | | | | | | |
| 9 | 4.214 | B01 | 0.87 | B01 | 3.13 | — | 5 |
| Invention example nr | | | | | | | |
| 6 | 3.925 | A07 | 0.87 | A07<br>B01 | 1.53<br>1.60 | 2.4 | 4 |
| 7 | 4.135 | A07 | 0.87 | A07<br>B01 | 2.33<br>0.80 | 3.2 | 3 |
| 8 | 4.188 | A07 | 0.87 | A07 | 3.13 | 4.0 | 1 |

The diffusion through the thermosensitive elements was assessed as described for the thermosensitive elements of COMPARATIVE EXAMPLES 1 to 4 and the results are summarized in Table 13. An improvement in diffusion through the thermosensitive elements over the situation with the at least one binder being 100% B01 was observed upon replacing 60% or more of the B01 with AB02, AB05 or A07.

The thermosensitive elements of COMPARATIVE EXAMPLE 9 and INVENTION EXAMPLES 6 to 8 were further coated with a protective layer as described for the substantially light-insensitive thermographic recording materials of COMPARATIVE EXAMPLES 1 to 4 and the image tone of the fresh thermographic recording materials determined as described for COMPARATIVE EXAMPLES 1 to 7 and INVENTION EXAMPLES 1 and 2, the results being summarized in Table 14.

The image tone becomes more neutral with increasing concentration of B01 for A07. Thermographic recording materials with thermosensitive elements containing AB05 with or without B01 give slightly more neutral image tones than thermographic recording materials with thermosensitive elements containing AB02 with or without B01 or A07 with or without B01 for comparable B01-concentrations.

TABLE 14

| | dispersion polymer/ added polymer | wt % first polymer | CIELAB values for fresh film for D = 1.0: a* | CIELAB values for fresh film for D = 1.0: b* | CIELAB values for fresh film for D = 2.0: a* | CIELAB values for fresh film for D = 2.0: b* |
|---|---|---|---|---|---|---|
| Comparative example nr. | | | | | | |
| 9 | B01/B01 | 0 | −1.8 | −7.7 | +1.8 | −5.3 |
| Invention example nr | | | | | | |
| 6 | A07/A07 + B01 | 68.7 | +0.9 | −7.8 | +3.3 | −7.5 |
| 7 | A07/A07 + B01 | 84.35 | +2.2 | −7.5 | +4.1 | −8.5 |
| 8 | A07/A07 | 100 | +3.1 | −5.0 | +5.5 | −6.9 |

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A substantially light-insensitive monosheet thermographic recording material comprising a support and on one side of said support a thermosensitive element, said thermosensitive element comprising at least one substantially light-insensitive silver salt of a carboxylic acid, at least one reducing agent therefor in thermal working relationship therewith and at least one binder, said at least one binder comprising at least one first polymer consisting of vinyl aceto-acetal monomer units and optionally monomer units selected from the group consisting of vinyl alcohol, vinyl acetate and itaconic acid monomer units, wherein the weight ratio of said at least one binder to said light-insensitive silver salt(s) of a carboxylic acid in said thermosensitive element is greater than 1.6; wherein said at least one binder optionally contains less than 40% by weight of a second polymer consisting of vinyl butyral monomer units and optionally vinyl alcohol and/or vinyl acetate monomer units; and wherein said thermosensitive element comprises at least one further first polymer.

2. The thermographic recording material according to claim 1, wherein said reducing agent is an ortho-dihydroxybenzene derivative.

3. The thermographic recording material according to claim 1, wherein said thermographic element further comprises at least one toning agent.

4. The thermographic recording material according to claim 3, wherein said toning agent is selected from the group consisting of naphthoxazine dione, naphthoxazine derivatives, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

5. A substantially light-insensitive monosheet thermographic recording material comprising a support and on one side of said support a thermosensitive element, said thermosensitive element comprising at least one substantially light-insensitive silver salt of a carboxylic acid, at least one reducing agent therefor in thermal working relationship therewith and at least one binder, said at least one binder comprising at least one first polymer consisting of vinyl aceto-acetal monomer units and optionally monomer units selected from the group consisting of vinyl alcohol, vinyl acetate and itaconic acid monomer units, wherein the weight ratio of said at least one binder to said light-insensitive silver salt(s) of a carboxylic acid in said thermosensitive element is greater than 1.6; wherein said at least one binder optionally contains less than 40% by weight of a second polymer consisting of vinyl butyral monomer units and optionally vinyl alcohol and/or vinyl acetate monomer units, wherein said thermosensitive element is provided with an outermost protective layer comprising the reaction product of at least one hydrolyzed polyalkoxysilane and a hydroxy-group containing polymer, and wherein said thermographic element further comprises at least one toning agent.

6. The thermographic recording material according to claim 5, wherein said polyalkoxysilane is tetramethoxysilane or tetra-ethoxysilane.

7. The thermographic recording material according to claim 5, wherein said hydroxy-group containing polymer is polyvinyl alcohol.

8. The thermographic recording material according to claim 5, wherein said thermosensitive element comprises at least one further first polymer.

9. The thermographic recording material according to claim 5, wherein said first polymer contains up to 17% by weight of vinyl alcohol monomer units.

10. The thermographic recording material according to claim 5, wherein said reducing agent is an ortho-dihydroxybenzene derivative.

11. The thermographic recording material according to claim 5, wherein said toning agent is selected from the group consisting of naphthoxazine dione, naphthoxazine derivatives, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

12. The thermographic recording material according to claim 5, wherein said at least one binder contains less than 40% by weight of a second polymer consisting of vinyl butyral monomer units and optionally vinyl alcohol and/or vinyl acetate monomer units.

13. A substantially light-insensitive monosheet thermographic recording material comprising a support and on one side of said support a thermosensitive element, said thermosensitive element comprising at least one substantially light-insensitive silver salt of a carboxylic acid, at least one reducing agent therefor in thermal working relationship therewith and at least one binder, said at least one binder comprising at least one first polymer consisting of vinyl aceto-acetal monomer units and optionally monomer units selected from the group consisting of vinyl alcohol, vinyl acetate and itaconic acid monomer units, wherein the weight ratio of said at least one binder to said light-insensitive silver salt(s) of a carboxylic acid in said thermosensitive element is greater than 1.6; wherein said at least one binder optionally contains less than 40% by weight of a second polymer consisting of vinyl butyral monomer units and optionally vinyl alcohol and/or vinyl acetate monomer units; wherein said first polymer contains up to 17% by weight of vinyl alcohol monomer units; and wherein said thermographic element further comprises at least one toning agent.

14. The thermographic recording material according to claim 13, wherein said thermosensitive element comprises at least one further first polymer.

15. The thermographic recording material according to claim 13, wherein said reducing agent is an ortho-dihydroxy-benzene derivative.

16. The thermographic recording material according to claim 13, wherein said toning agent is selected from the group consisting of naphthoxazine dione, naphthoxazine derivatives, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

17. The thermographic recording material according to claim 13, wherein said thermosensitive element is provided with an outermost protective layer comprising the reaction product of at least one hydrolyzed polyalkoxysilane and a hydroxy-group containing polymer.

18. The thermographic recording material according to claim 17, wherein said polyalkoxysilane is tetramethoxysilane or tetra-ethoxysilane.

19. The thermographic recording material according to claim 17, wherein said hydroxy-group containing polymer is polyvinyl alcohol.

20. The thermographic recording material according to claim 13, wherein said at least one binder contains less than 40% by weight of a second polymer consisting of vinyl butyral monomer units and optionally vinyl alcohol and/or vinyl acetate monomer units.

21. A substantially light-insensitive monosheet thermographic recording material comprising a support and on one side of said support a thermosensitive element, said thermosensitive element comprising at least one substantially light-insensitive silver salt of a carboxylic acid, at least one reducing agent therefor in thermal working relationship therewith and at least one binder, said at least one binder comprising at least one first polymer consisting of vinyl aceto-acetal monomer units and optionally monomer units selected from the group consisting of vinyl alcohol, vinyl acetate and itaconic acid monomer units, wherein the weight ratio of said at least one binder to said light-insensitive silver salt(s) of a carboxylic acid in said thermosensitive element is greater than 1.6; and wherein said at least one binder contains less than 40% by weight of a second polymer consisting of vinyl butyral monomer units and optionally vinyl alcohol and/or vinyl acetate monomer units.

22. The thermographic recording material according to claim 21, wherein said thermosensitive element comprises at least one further first polymer.

23. The thermographic recording material according to claim 21, wherein said reducing agent is an ortho-dihydroxy-benzene derivative.

24. The thermographic recording material according to claim 21, wherein said thermographic element further comprises at least one toning agent.

25. The thermographic recording material according to claim 24, wherein said toning agent is selected from the group consisting of naphthoxazine dione, naphthoxazine derivatives, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

* * * * *